US005413666A

United States Patent [19]

Orlandi

[11] Patent Number: 5,413,666

[45] Date of Patent: May 9, 1995

[54] BOTTLE-BEARING PLATE WITH A CENTERING DEVICE, IN A LABELING MACHINE

[75] Inventor: Ireneo Orlandi, S. Giorgio di Mantova, Italy

[73] Assignee: Alfa Construzioni Meccanische S.p.A., Mantova, Italy

[21] Appl. No.: 141,265

[22] Filed: Oct. 22, 1993

[30] Foreign Application Priority Data

Jan. 26, 1993 [IT] Italy ..... PR93A0002

[51] Int. Cl.[6] ..... B65C 9/00

[52] U.S. Cl. ..... 156/566; 156/447; 156/456; 156/DIG. 27; 198/394

[58] Field of Search ..... 156/446, 447, 448, 449, 156/566, 567, 571, DIG. 13, DIG. 26, DIG. 27, 456; 198/379, 382, 388, 394, 414

[56] References Cited

U.S. PATENT DOCUMENTS

| | | | |
|---|---|---|---|
| 4,143,754 | 3/1979 | Eldred | 156/DIG. 26 X |
| 4,529,469 | 7/1985 | Jorss | 156/DIG. 27 X |
| 4,594,123 | 6/1986 | Eder | 156/571 X |
| 4,721,544 | 1/1988 | Zodrow et al. | 156/567 X |
| 5,004,517 | 4/1991 | Orlandi | 198/394 X |
| 5,121,827 | 6/1992 | Ribordy | 156/567 X |
| 5,137,136 | 8/1992 | Humele | 156/DIG. 27 X |

FOREIGN PATENT DOCUMENTS

| | | |
|---|---|---|
| 0443617 | 8/1991 | European Pat. Off. . |
| 3308489 | 9/1984 | Germany . |
| 3938837 | 6/1990 | Germany . |

*Primary Examiner*—David A. Simmons
*Assistant Examiner*—James J. Engel
*Attorney, Agent, or Firm*—Darby & Darby

[57] ABSTRACT

The invention relates to the field of labeling machines for bottles provided with a reference recess (13) on the bottle base, which recess (13) can be used to effect the centering of the labels on the bottle: more precisely the invention relates to a bottle-bearing plate, comprising an internal body (3) which can slide vertically and rotate about its own axis, and which is non-contactingly surrounded by an external body (2) which can be engaged and raised by the internal body (3) after an initial non-contacting upward-moving rotation. A centering ring (4) is fixed to the external body (2), which ring (4) perfectly reproduces the the external surface curvature of the bottle at its base. A centering device (5), destined to insert into the reference recess (13), is fixed to the internal body (3).

6 Claims, 5 Drawing Sheets

BOTTLE-BEARING PLATE WITH A CENTERING DEVICE, IN A LABELING MACHINE

BACKGROUND OF THE INVENTION

The invention relates to a bottle-bearing plate with a centering device, in a labeling machine. In particular the invention is applicable to the labeling of bottles having very concave bases and therefore not presenting a large base surface on which they can adhere on a rest plane or a plate. Such bottles are provided with a reference recess sunk into the bottle base surface, but the recess is limited in radial length due to the very concave shape of the bottle base.

High-speed labeling machines generally comprise a platform, known as a turntable, which rotates about a central vertical axis. Labeling, smoothing and brushing stations are positioned about the turntable.

On the platform of the machine, a plurality of plates are mounted which can rotate about themselves, and onto which the bottles or containers are transported by a star conveyor.

The rotation of the plates is used to position the bottles at a determined position with respect to the labeling stations so that the labels can be positioned at a precise position on the bottles. Prior art centering devices, especially those for the above-described type of bottle, usually exhibit plates having an internal pad which acts on the base of the bottle.

Centering devices of this type present only a small blocking surface for the bottle, leaving the bottle prone to angular movements, leading to possibly incorrect label positioning.

A further drawback is due to the fact that the bottles almost always exhibit milling or ribbing around the base, which lead to considerable wear on the generally rubber pad.

SUMMARY OF THE INVENTION

The principal aim of the present invention is to provide a device which, in centering the bottle, acts on the lateral surface of the bottle itself in the zone next to the base, so that all of the reference recess can be exploited in the interest of correctly positioning the bottle.

A further aim is to avoid wear on the centering stations.

These and other aims are fully attained by the bottle-bearing plate with centering device, object of the present invention, which is characterised as in the following claims.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which.

DESCRIPTION OF THE PREFERRED EMBODIMENTS

Figure 1:
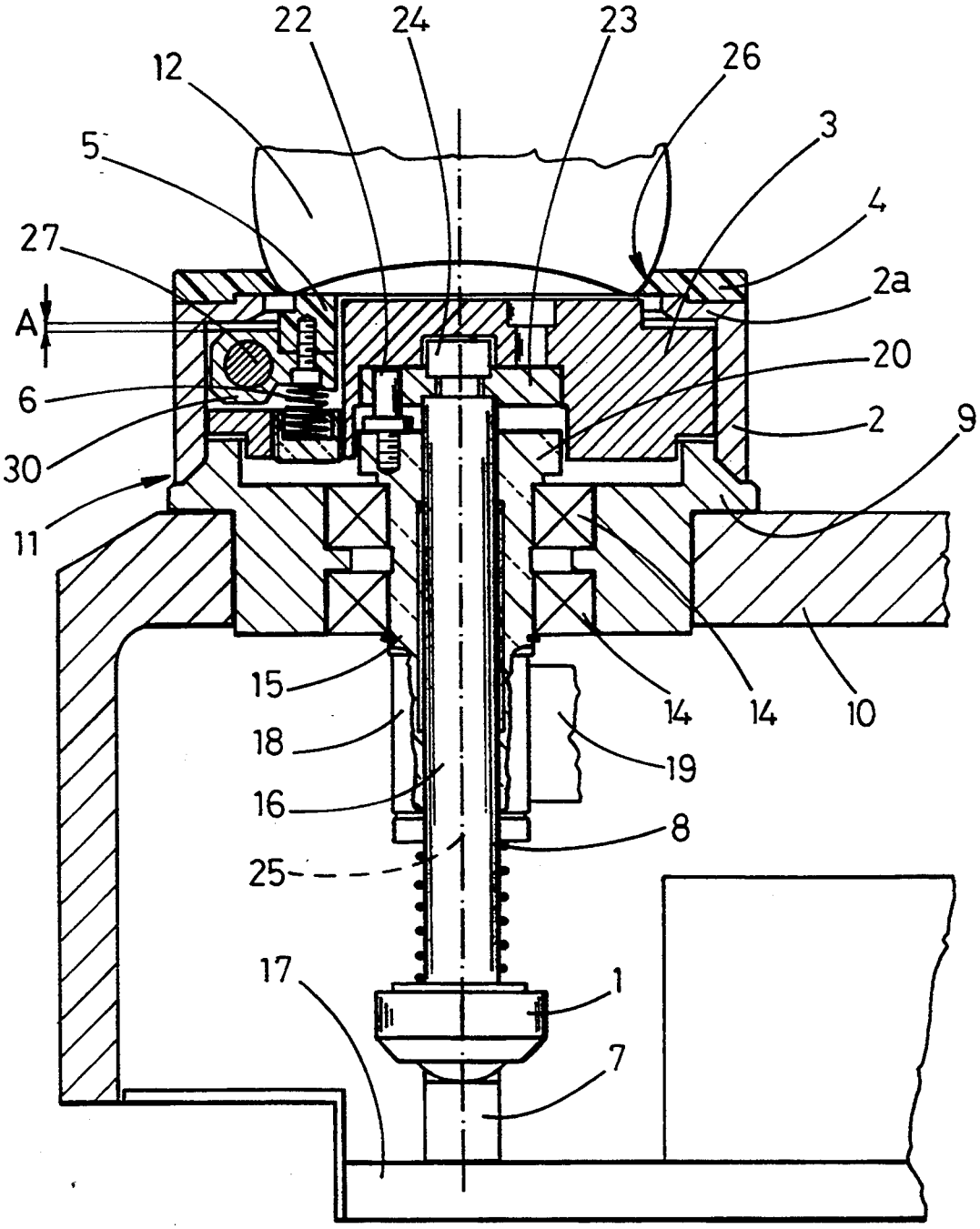
FIGS. 1, 2, 3 and 4, show the plate in longitudinal section at four work phases and in a first embodiment.

With reference to the figures, 10 denotes a platform rotating about a vertical axis, commonly known as a turntable.

A plurality of plates 11 are mounted on the turntable 10. Each of the plates 11 receives a bottle 12 from a star conveyor (not shown in the illustrations). The bottles 12 are all provided with a recess 13.

Each plate comprises a support ring 9 solid to the turntable 10 and housed in a circular through hole made in the turntable 10.

The support ring 9 bears two bearings 14 which support a rotating bushing 15 in which a pivot 16 is inserted, which pivot 16 can translate coaxially to the bushing 15, but which cannot rotate independently of the bush 15.

The pivot 16 bears at its bottom a head 1 which is kept pressed against a cam 7 fixed to the fixed frame 17 of the labeling machine by means of a spring 8 inserted between the head 1 and a cogwheel 18.

The cam 7 is a ring having a varied-height top profile in order to make the pivot 16 slide vertically. The cogwheel 18 above the bushing 15 meshes with a motorized cogged section 19 so as to cause the pivot 16 to rotate by one full turn. A pawl 21 is inserted into a crown 20 which is positioned above the bushing 15. The pawl 21 is inserted, which pawl 21 projects upwards and inserts slidingly into a hole 22 of a disc 23, which disc 23 is fixed by means of a screw 24 at the pivot 16 head.

An internal body 3 is fixed to the disc 23, which internal body 3 can rotate about its vertical axis 25 and contemporaneously can slide vertically in axial direction (axis 25) when so commanded by the cam 7.

The internal body 3 is surrounded by an external body 2 which is freely inserted like a cover about the said internal body 3 and can thus be drawn by the internal body 3 during its upwards sliding. The external body 2, cylindrical in shape, is equipped with a contact ring **2*a* which rests against the internal body 3**.

A centering ring 4 is fixed on the contact ring **2*a* which centering ring 4 internal surface 26** perfectly echoes the external surface curvature of the bottle at its base portion.

The internal body 3 houses a lever 30 pivoted at 27 and pressed upwards by a spring 6. A shaped tooth 29 is fixed to the lever 30, the shape of the tooth 29 being such as to penetrate into the recess 13. The lever 30 together with the shaped tooth 29 constitute a centering device, denoted in its entirety by 5.

The functioning of the device will now be described.

Figure 2:
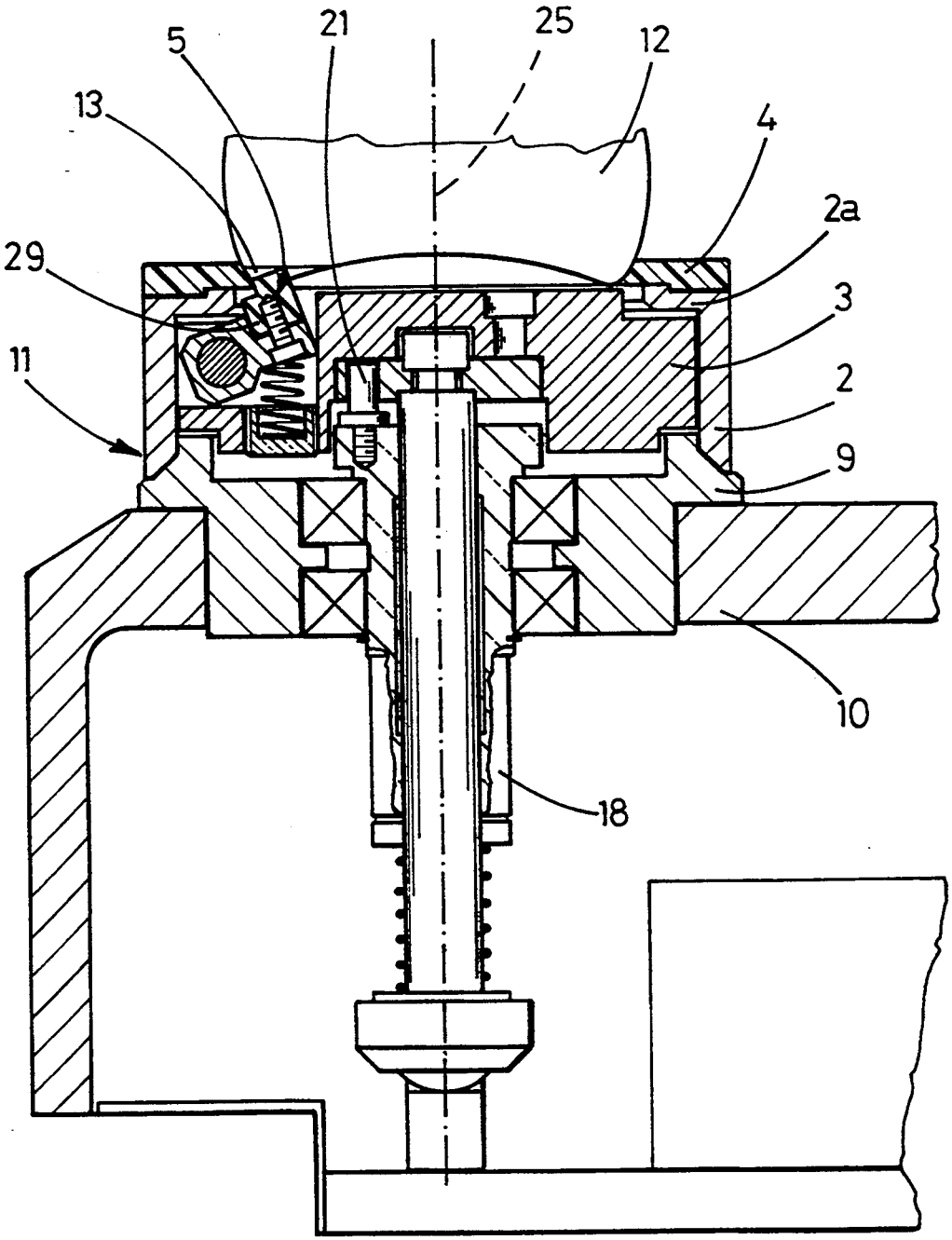

The bottle reaches the plate by means of a star transporter (not illustrated) and inserts into the centering ring 4 as in FIG. 1. The head 1, pushed by the spring 8, is at this point following the lower profile of the cam 7, creating the distance between the internal body 3 and the external body 2. The external body 2 then rests on the support ring 9. The bottle enters into the centering ring 4 and presses the tooth 29 downwards. The spring 6 maintains contact between the tooth 29 and the base of the bottle, which bottle base is not resting on the internal body 3. The bottle is kept still because the external body 2 cannot rotate because of its contact with the support ring 9. The internal body 3 starts rotating and brings the tooth 29 into contact with the bottle recess 13, drawing the bottle into the pretermined position (see FIG. 2).

At this point the bottle rotates in the centering ring 4.

Figure 3:
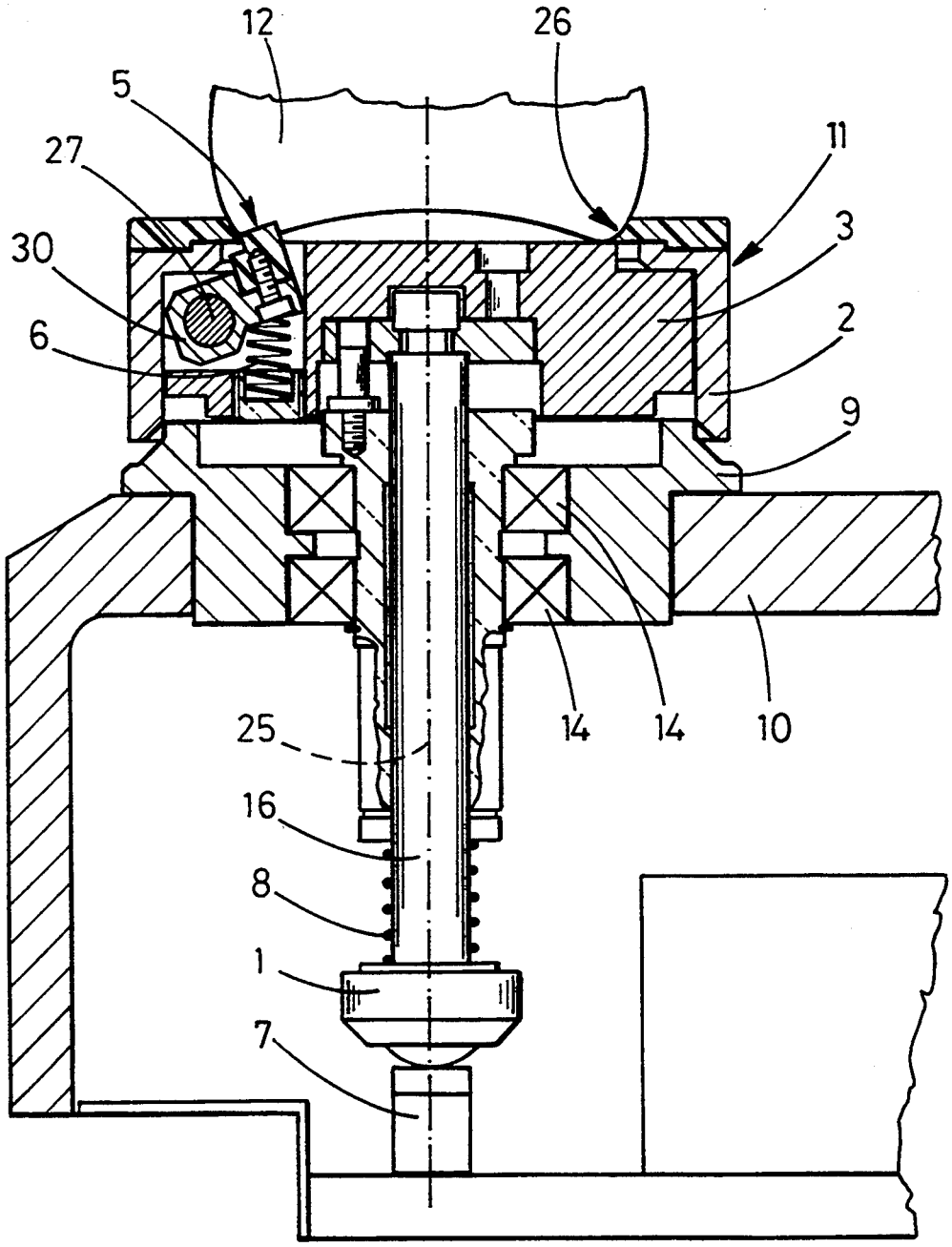

With reference to FIG. 3, subsequently the head 1 meets the upper profile of the cam 7 and thus the internal body 3 lifts, cancelling the distance between it and the bottle, and also distancing the external body 2 from the support ring 9.

Thus the bottle rotates for the subsequent labeling and finishing phases, the external body 2 being raised and free to rotate with the internal body 3.

Figure 4:
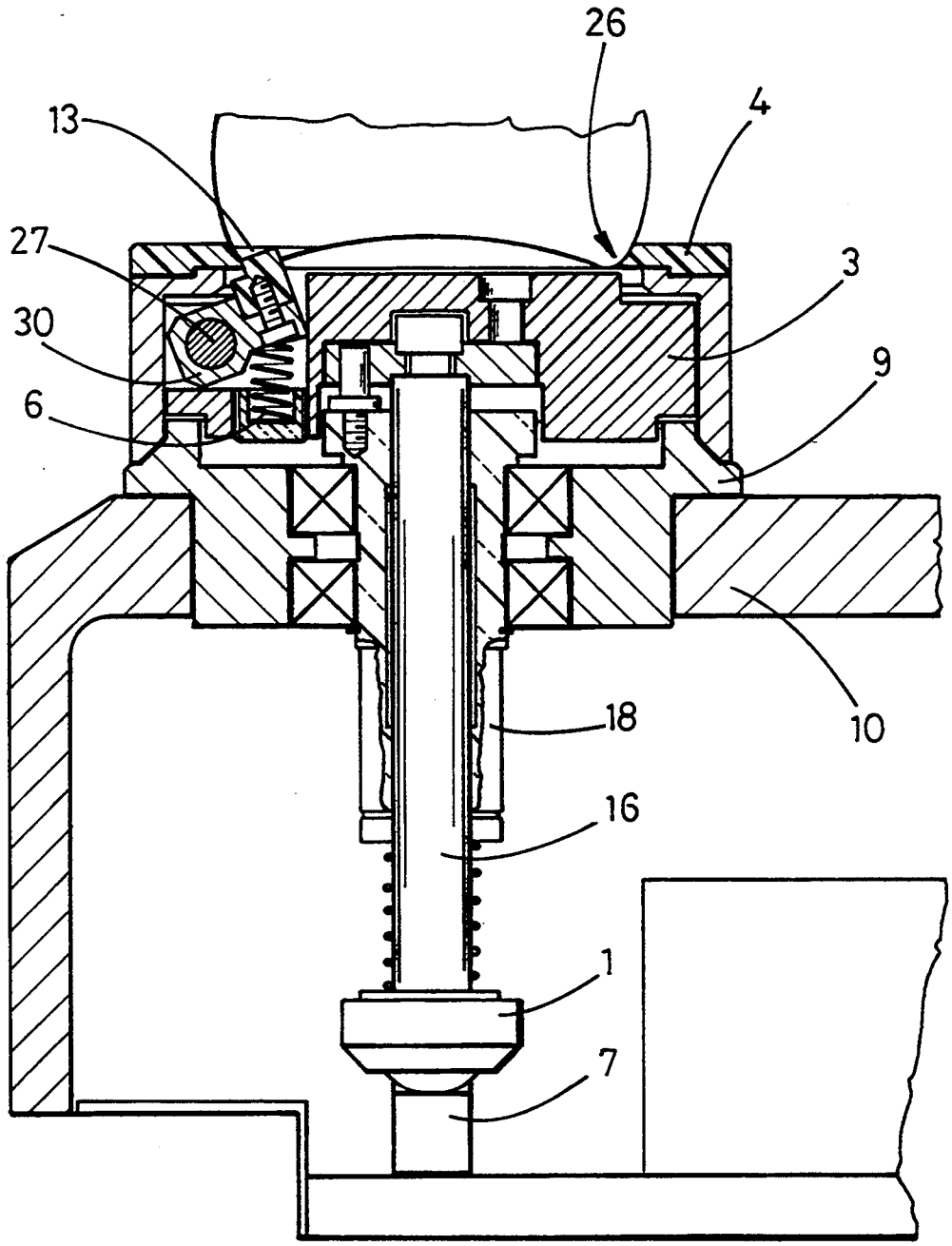

In the final phase illustrated in FIG. 4, the head 1 returns to the lower profile of the cam 7, and the bottle is drawn away form the centering ring 4 by a star conveyor.

Figure 5:
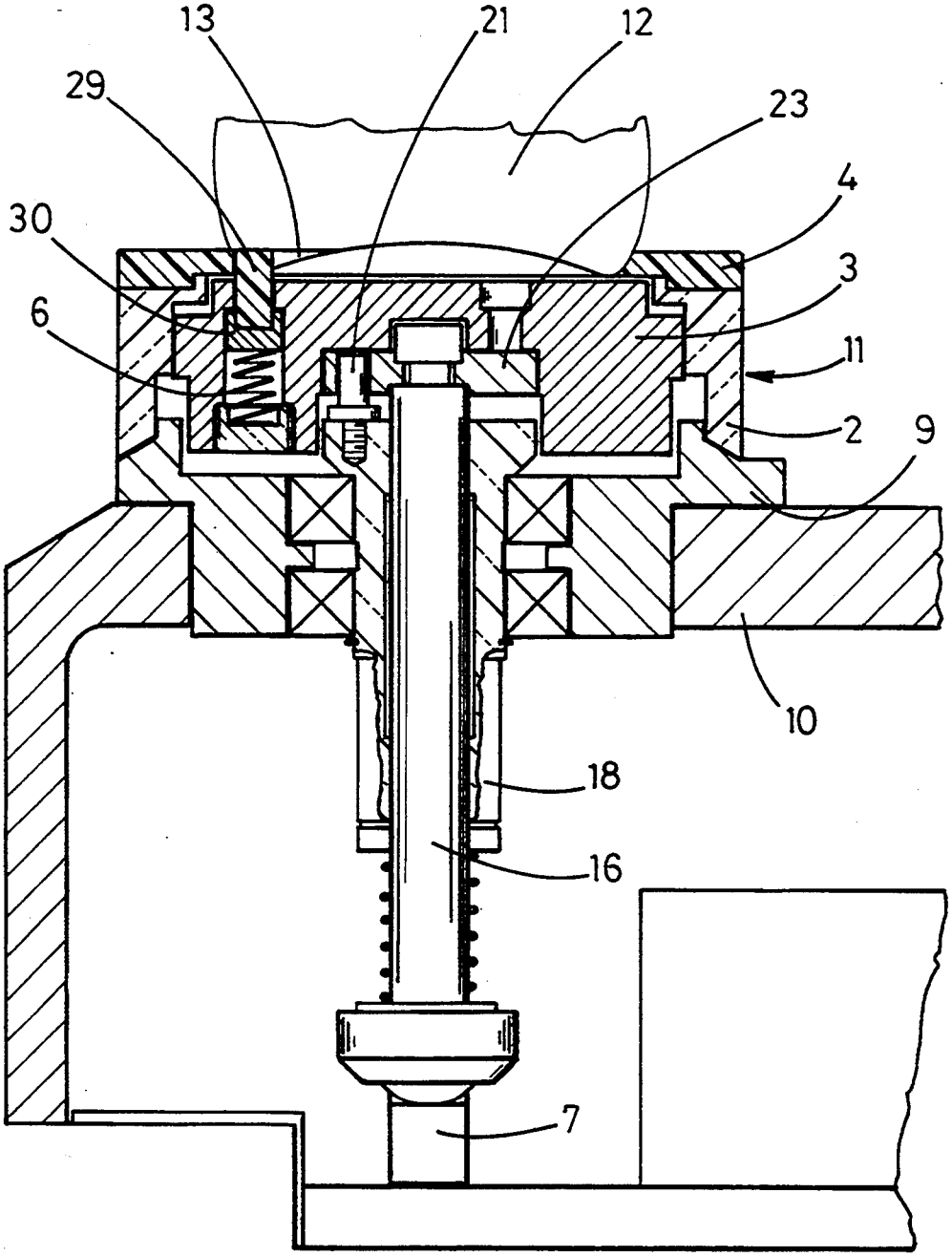
FIG. 5 shows the plate in a second embodiment, in the same view as the first four figures.

In the embodiment shown in FIG. 5, the rotation axis of the lever 30 is rotated by 90 degrees in the same plane, for which reason the tooth 29 will not penetrate the recess 13 radially, as in the first embodiment.

What is claimed:

1. A bottle-bearing plate with centering device for labeling machines, comprising a turntable rotating about its own vertical axis at which peripheral zone a plurality of plates are supported, wherein each plate comprises:

a support ring (9) fixed to the turntable;

an internal body (3) which rests on the support ring (9) and which is able to slide vertically and rotate with respect to the support ring (9);

an external body (2) which surrounds the internal body (3) and which, after a first free vertical-direction sliding-rotating phase of the internal body (3), can be engaged and drawn by the internal body (3) when the internal body (3) continues moving vertically upwardly after the first free sliding-rotating phase;

a centering ring (4), fixed to the external body (2), an internal surface (26) of which centering ring (4) perfectly recreates a curvature of an external surface of the bottle at a bottle base zone, a centering device (5) being housed in the internal body (3), which centering device (5) inserts into a reference recess (13) made in the bottle base, the upwardly vertical sliding-rotating of the internal body (3) being such as to bring the bottle from a sliding phase on the centering ring (4) to a phase of non-contact between the external body (2) and the support ring (9) causing rotation of the bottle so that a labeling phase can be carried out.

2. A bottle-bearing plate as in claim 1, comprising a support ring (9) provided with a central hole into which a bushing (15) is inserted, which bushing (15) externally bears a cogwheel (18) meshing with a motorised cogged section (19), a vertically slidable pivot (16) being inserted in the bush (15), which pivot (16) is elastically pressed against a cam (7), the internal body (3) being fixed to the pivot (16) and the bush (15).

3. A plate as in claim 1, wherein the external body (2) is provided with a contact ring (*2a*) which rests on the internal body (3), the centering ring (4) being fixed on a superior part of the said contact ring (*2a*).

4. A plate as in claim 1, wherein the centering device (5) comprises a tooth (29) solid to a lever (30), which lever (30) is pivoted to the internal body (3) and is kept elastically pressed upwards in an area in proximity of an internal surface (26) of the centering ring (4) in which zone the reference recess (13) of the bottle base is located.

5. A plate as in claims 1 and 4, wherein a tooth (29), solid to the lever (30), can rotate radially to the plate.

6. A plate as in claims 1 and 4, wherein a tooth (29), solid to the lever (30), can rotate tangentially to the plate.

* * * * *

UNITED STATES PATENT AND TRADEMARK OFFICE

CERTIFICATE OF CORRECTION

PATENT NO. : 5,413,666

DATED : May 9, 1995

INVENTOR(S) : Ireneo Orlandi

It is certified that error appears in the above-indentified patent and that said Letters Patent is hereby corrected as shown below:

On the title page, [73] Assignee: "Meccanische" should be —Meccaniche—
[30] Foreign Application Priority Data, "PR93A0002"

should be —PR93A000002—.

Signed and Sealed this

Twenty-fifth Day of July, 1995

Bruce Lehman

*Attest:*

BRUCE LEHMAN

*Attesting Officer*

*Commissioner of Patents and Trademarks*